United States Patent [19]

Rudy

[11] Patent Number: 4,486,964

[45] Date of Patent: Dec. 11, 1984

[54] SPRING MODERATOR FOR ARTICLES OF FOOTWEAR

[76] Inventor: Marion F. Rudy, 19001 Vintage St., Northridge, Calif. 91324

[21] Appl. No.: 389,866

[22] Filed: Jun. 18, 1982

[51] Int. Cl.[3] ..... A43B 13/48

[52] U.S. Cl. ..... 36/28; 36/38; 36/44

[58] Field of Search ..... 36/69, 29, 35 B, 43, 36/37, 28, 38, 44

[56] References Cited

U.S. PATENT DOCUMENTS

| | | | |
|---|---|---|---|
| 2,255,100 | 9/1941 | Brady | 36/37 |
| 2,660,814 | 12/1953 | Ritchey | 36/37 |
| 3,120,712 | 2/1964 | Menken | 36/29 |
| 3,253,355 | 5/1966 | Menken | 36/29 |
| 4,183,156 | 1/1980 | Rudy | 36/29 |
| 4,219,945 | 9/1980 | Rudy | 36/29 |

*Primary Examiner*—Werner H. Schroeder
*Assistant Examiner*—Tracy Graveline
*Attorney, Agent, or Firm*—Beehler, Pavitt, Siegemund, Jagger & Martella

[57] ABSTRACT

An improved spring moderator for articles of footwear which absorbs, redistributes, and stores energy of localized loads and forces, through elastic deformation, and then returns the energy to the user in useful forms as the load is then removed, while providing comfort and support.

19 Claims, 8 Drawing Figures

SPRING MODERATOR FOR ARTICLES OF FOOTWEAR

BACKGROUND OF THE INVENTION

1. Field of the Invention

This invention relates to moderators and stabilizers of footwear, and more particularly to an improved spring moderator and stabilizer which absorbs, redistributes, and stores energy of localized loads and forces, through elastic deformation, and then returns the energy to the user in useful form as the load is removed, while providing comfort and support.

2. Description of the Prior Art

There are numerous articles of footwear in the prior art in which inserts and supporting members are present, principally for the purpose of providing comfortable support to the human foot. For example, U.S. Pat. No. 3,120,712 of 1964 issued to Menken describes a shoe construction which includes a bladder filled to a pressure of about 300 psi. A steel plate overlies the bladder to confine it, and, at a pressure of 30 psi, the plate must support a force of 600 pounds and must, accordingly, be extremely rigid and inflexible.

U.S. Pat. No. 2,237,190 of 1941 issued to McLeod describes a shoe incorporating supporting members of springy material which supporting members are corrugated transversely and are thus rigid in a transverse orientation.

U.S. Pat. No. 3,253,355 of 1966 also issued to Menken also describes the use of a stiff plate over an inflatable bladder.

Other patents exist which describe a stiffening or reinforcing plate in the shoe structure, such as arch support devices and the like.

U.S. Pat. No. 4,183,156 discloses a "moderator" described as uniformly distributing relatively high loads associated with fluid-containing chambers in the shoe structure. The moderator is described as being relatively thin, 0.005 to 0.080 of an inch, and is described as being "semi-flexible" to conform to the dynamic contours of the plantar. This prior moderator, however, does not perform the function of an energy transfer mechanism, but is used solely for foot comfort.

While the above described inserts and supporting members and moderators, as well as others described in the prior art, are said to perform in a manner satisfactory for the purposes therein disclosed, none of the prior art has provided a moderator of the structure and function of the moderator of this invention.

More specifically, the moderator of this invention provides a variety of unique qualities and functions not heretofore achieved. For example, it is known in the prior art to use foamed inserts or inflatable inserts, normally used as in-soles in footwear. U.S. Pat. No. 4,183,156 and U.S. Pat. No. 4,219,945 describe inflatable inserts and combinations thereof with elastomeric materials. The latter patents represent an improvement of the prior art in that the described in-soles absorb localized forces and redistribute these forces from the localized area, the absorption of forces operating throughout the fluid system of the in-sole. In effect, the fluid system acts as a pneumatic spring. The moderator of this invention, which is in the nature of a mechanical spring, enhances and improves the energy absorption, redistribution, storage and energy return of the above types of in-soles. Where the in-sole is an all-foam, non-inflatable type of insert, the moderator of the present invention provides similar improved benefits.

In general, the moderators of the prior are rigid and inflexible and do not conform to the wearer's foot or are rigid and inflexible in order to support the foot in a predetermined manner. Alternatively, some are moldably flexible to conform to a desired contour of the foot. In some of the prior art structures the energy of the applied localized load is merely absorbed, and little, if any, of the absorbed energy is returned in a useful form. Where the energy is merely absorbed, it is usually dissipated in the form of heat and over a period of time the generated heat may adversely affect the footwear.

With footwear to be used in sports related activities, or in severe types of physical activities, the interaction between the foot, footwear and the surface may vary widely, depending upon the nature of the particular activity, the footwear, and the surface. For example, in long distance running, the sequence generally involves heel strike, pronation, and toe-off propulsion phases followed by a "float phase". The foot is actually on the ground only a relatively short period, for example, less than 0.04 of a second, and the loading on the foot may be quite high. In the heel strike phase, from two to eight times the body weight comes down on the heel in a comparatively short period, and the localized loads may range from about 400 to 1,000 pounds. Where the surface is hard, for example, concrete or hardtop, and the footwear is non-compressible, the high loads are absorbed by the heel and transmitted through the related bone structure to the remainder of the body. Thus, from the standpoint of comfort, either a soft running surface or a soft cushioned shoe structure, or a combination thereof would seem to be desirable.

However, the toe-off propulsion phase tends to require firmness because of the propulsion mechanism. Here, a hard surface and a non-compressible shoe structure, or a combination thereof, would seem to be desirable. For footwear of a given type, the effect may be different for different types of surfaces, e.g., sand, concrete, or hardwood surfaces. Sand is yielding and while it cushions heel strike better than does concrete or hardwood, the yielding nature makes toe-off propulsion more strenuous. Concrete and hardwood favor the dynamics of toe-off propulsion, and hardwood is preferable over concrete because hardwood is more resilient than concrete, and tends, to some extent, to cushion heel strike. While the resiliency of hardwood compared to concrete might not seem significant in terms of absolute numbers, it is significant from the standpoint of foot comfort and physical activities.

From the nature of long-distance running, there is a significant impact at heel strike which is returned to the athlete through the calcaneus, and to the legs and torso as an upward and forward energy, i.e., a movement which includes both a vertical and horizontal component. The absorption, redistribution, storage and return of this energy would be of value to a runner. Even small increases in efficiency, as determined by oxygen measurement uptake, are physiologically significant, and can be translated into increased speed. For example, an energy savings of 0.8% is equivalent to roughly one minute and 25 seconds in a three-hour marathon, and about one minute in a two-hour-and-ten-minute marathon. Accordingly, a relatively lightweight, comfortable shoe, which increases efficiency, even if by a comparatively small percentage of two percent to 6 percent, for example, represents a significant advance in the art.

Even the nature of the physical activity is a factor in footwear design and engineering. Long-distance running involves repeating cycles of heel strike, pronation, toe-off propulsion followed by a float phase with reasonably repeatable loads. In basketball, for example, the situation is quite different, because the cycle is not repeatable due to the variety of activities in the sport and the loads encountered when the foot or some portion thereof comes into contact with the floor, and such loads may be significantly higher than those involved in running. A basketball player may come down on the ball or heel of one foot after a high jump and the localized loads encountered may be significantly in excess of those normally encountered in the heel strike phase of long-distance running. Further, the nature of the sport is such that quick starts, stops and changes of direction are all possible in a random, non-cyclicle manner. To some extent, the same is true in sports such as soccer played on artificial turf or grass, but the surface tends to be more resilient than the hardwood surface. Also, tennis presents the same variety of foot motion, although high jumps are not as frequent.

It is known from U.S. Pat. No. 4,183,156 that partilar types of inflatable in-sole structures there described are capable of absorbing localized forces and storing and returning mechanical energy to the foot and leg so as to reduce the "energy of locomotion" consumed in running, walking and jumping. As described in the above-identified patent, displacement energy is absorbed from the foot by the inflated in-sole as the foot makes contact with the ground, the energy being converted to fluid pressure energy and stored within the inflated in-sole and then is converted back to energy of motion at the end of the stride as the foot leaves the ground. The described in-soles are initially filled with a "supergas", which through diffusion later includes those gases contained in air in an amount equal to their partial pressure in air.

While the above-described in-soles operate satisfactorily and include moderators to provide comfort, for some applications it was believed necessary to use relatively high pressures and/or relatively high density foams to withstand the relatively high localized loads produced in certain types of activities such as jumping. Further, while those in-soles were effective in absorbing and converting the energy ultimately into energy of locomotion, more effective use of the available energy was not achieved. More specifically, the redistribution of energy was related to the communicating fluid passages for the air-gas mixture, thus requiring in-sole geometries which tended to be difficult as a practical matter. Elastic deformation was not used as a vehicle in the energy storage or distribution chain and the storage of energy was not as efficient as could be achieved. Even relatively small increases in energy return effect a significant improvement over the prior art structures.

One of the advantages of the inflatable in-sole structures was the adiabatic compression in response to applied loads and the transfer of energy at a relatively high rate approximating the speed of sound, i.e., 1088 feet/second. Energy was also transferred through the elastomeric or plastic material which formed the fluid passages, but the rate of energy transfer was significantly less than that through the air-gas mixture. In the case of foam materials, the rate of energy transfer is relatively slow, e.g., about 100 feet per second or less. The result was that in some instances the dynamics of energy adsorption, distribution and return was not "tuned" to the wearer's activity. The result was that the available energy was not efficiently used, having in mind that even seemingly small increases in energy savings may have a significant impact on the performance of the athlete or the wearer.

It is also apparent that comfort is a factor in athlete efficiency of performance in the sense that the body may expend energy compensating for impact and shock loads experienced in running. The reduction of the effect of these loads by the provision of a comfortable shoe which provides proper support and return of some of the energy involved in shock loads offers advantages not heretofore obtained. In effect, the provision of a shoe which provides comfort and support which does more than merely adsorb and dissipate the shock loads would provide advantages not achievable by the prior art devices.

In view of the foregoing, one of the objects of this invention is to provide an improved moderator which cooperates with the other components of the foowear to absorb, redistribute, store and return energy to the user in a far better fashion than can be achieved by the same structure without the moderator of this invention.

More specific objects of this invention include:

(a) Achievement of a "banked track" effect between the foot and the running surface proportional to the applied vector forces;

(b) Achievement of improved running efficiency when properly combined with an air-gas in-sole system;

(c) Improvement of stability at heel strike and toe-off of footwear regardless of whether and air-gas in-sole system is used;

(d) Providing improved and increased support for individuals defined as "pronators";

(e) Cooperating with the heel counter of the footwear to create a dynamic cupping action to snug the heel counter more firmly around the heel of the foot at moments of severe downward and lateral impact between the foot and the ground;

(f) Permitting the use of softer foam and/or lower pressure air-gas in-soles to tune more precisely the dynamics of the shoe to the athlete and to the activity, for example, running, tennis, basketball, track, soccer, football, etc.;

(g) Adsorbing, redistributing and storing the energy of localized loads and forces through elastic deformation and then returning the energy to the athlete as the load is removed;

(h) When used with footwear or in-sole constructions of the type described in U.S. Pat. Nos. 4,183,156; 4,219,156; 4,219,945, and 4,271,606 the moderator structure of the present construction (i) increases the energy adsorption capability of the entire structure;

(ii) achieves a better balance between comfort and firmness in the shoe structure;

(iii) improves the "jump height" blocking and stopping characteristics of tennis and court shoes; and (iv) enhances and improves the energy absorption, redistribution, storage and energy return characteristics of those shoes and in-sole structures;

(i) Offers the advantage of use of foam in-sole components which are softer, less dense, and thus of lighter weight, while retaining softness in the shoe and providing firmness, while also providing the energy characteristics previously described;

(j) Permits the use of low-pressure and inflatable inserts and lower density foams, while eliminating "bottoming-out", while still providing a soft cushion feel, firmness, support and comfort; and, (k) Enhances and improves the energy absorption, redistribution, storage and energy return characteristics of the foam or air-gas filled in-sole.

BRIEF DESCRIPTION OF THE INVENTION

By the present invention, the energy expenditure of the athlete is reduced significantly in performing the same level of work effort when the footwear includes a moderator of the present invention as compared to the same shoe without such a moderator.

The foregoing objects and advantages are achieved by an improved spring moderator of high modulus of elasticity which is lightweight and cooperates with other components of the in-sole, insert or shoe structure to absorb, redistribute, store and return to the athlete through elastic deformation, the energy of localized loads, and in a useful form as the localized loads are removed. In effect, the present invention provides firmness and support, while providing softness and cushion, however, the absorbed energy is returned in a useful form.

The moderator is a spring-type material so located in the shoe structure as to absorb the high unit loads and which functions to redistribute the loads radially in all directions and almost instantaneously and in proportion to the applied load. The moderator functions to displace or deflect in response to a load and to transmit the load laterally as compared to the distribution of loads in the case of fluid-filled and foam-filled materials. More specifically, fluid-filled and foam-filled materials function to absorb downward loads, the fluid materials operating better than foams in this regard. However, when used with the high-modulus moderator of the present invention, the absorption of loads is improved due to the almost instantaneous response of the moderator and the essentially uniform lateral distribution thereof. Further, while providing a soft cushion, the moderator provides firmness and support with the other components of the insert, in-sole or shoe.

Thus, for example, the high-modulus moderator comfortably and efficiently absorbs high shock forces at heel strike. The high localized forces at heel strike (centered at the calcaneus) are redistributed to the distal and of the calcaneus, both downwardly and laterally. This redistribution characteristic is related to the thickness and geometry of the moderator such that the greater the applied localized force the greater the deflection and the greater the load distribution.

At the first instant of heel strike, the applied force is relatively light and there is a small degree of load redistribution. As the heel strike phase continues and the forces build, continued downward movement of the calcaneus produces (a) elastic deformation of the heel portion of the moderator, and (b) redistribution of the localized load of the calcaneus outwardly over the softer supportive foam- or fluid-filled material. The result is a comparatively soft and comfortable support quality under higher load and force conditions. As the load increases, however, the moderator structure becomes increasingly firm and supportive, and the maximum shock load is absorbed without "bottoming-out" of the foam- or fluid-filled component.

During the operation above described, the moderator element is, through deflection, shaped to cup and center the calcaneus in the shoe at the instant of full heel strike with the result that the psi loading on the fatty tissue surrounding the calcaneus is reduced. This action reduces the need for stiff heel counters whose purpose is to keep the heel of the foot properly positioned and supported within the shoe. By supporting and centering the calcaneus, the moderator structure of this invention achieves a "banked track" effect for the heel in response to rapid changes in direction of body movement, and offers the advantage of increased stability on irregular terrain, e.g., cross-country running.

The moderator, in the fully deflected, cupped shape now resembles a Bellville spring. The shock and impact energy at heel strike has been completely absorbed in the deflected high-modulus moderator and the cushioning substrate or mid-sole material, i.e., foam- or fluid-filled material. As the center of pressure moves forward after the maximum downward movement of the calcaneus at heel strike, the load-bearing area of the plantar surface of the foot increases rapidly and the psi loading on the moderator assembly is reduced rapidly. At this point, much of the high-impact heel strike energy is returned to the foot (calcaneus) and the leg and the body by the spring moderator and also the cushioning substrate. At full pronation, the calcaneus has been thrust upward to a level substantially higher than at mid-heel strike, thus reducing the downward movement of the center of gravity of the body.

The moderator may take various forms and shapes and it may be located on various places under the foot or at various locations within the shoe structure. Regardless of the location of the moderator of this invention, its characteristics are that it deflects without permanent deformation and in response to an applied load which creates a deflecting stress. Upon removal of or progressive reduction of the applied load, the moderator returns to its original shape. In so doing, the moderator almost instantaneously returns energy to the wearer, since the response of the spring is almost instantaneous, i.e., as the load is removed the spring returns to its original shape. Moreover, the rate of energy transfer in the spring material of the moderator is significantly higher than the rate of energy transfer through the air-gas component of the air-gas in-sole. The result is that the energy return fairly matches the rate at which the load changes with the result that the shoe is "tuned" to the wearer's needs. Thus, it is important that the moderator be of a shape and be so located within the shoe that it is able to deflect and return to its original shape. In addition, the moderator cooperates with the other components of the shoe structure to provide support and comfort which also tends to reduce the expenditure of energy in compensating for the localized shocks and loads encountered in the various types of physical activities.

Numerous other objects and advantages of the present invention will become apparent from the following specification, which, together with the accompanying drawings, describes and illustrates preferred embodiments of this invention.

DETAILED DESCRIPTION OF THE INVENTION

Figure 1:
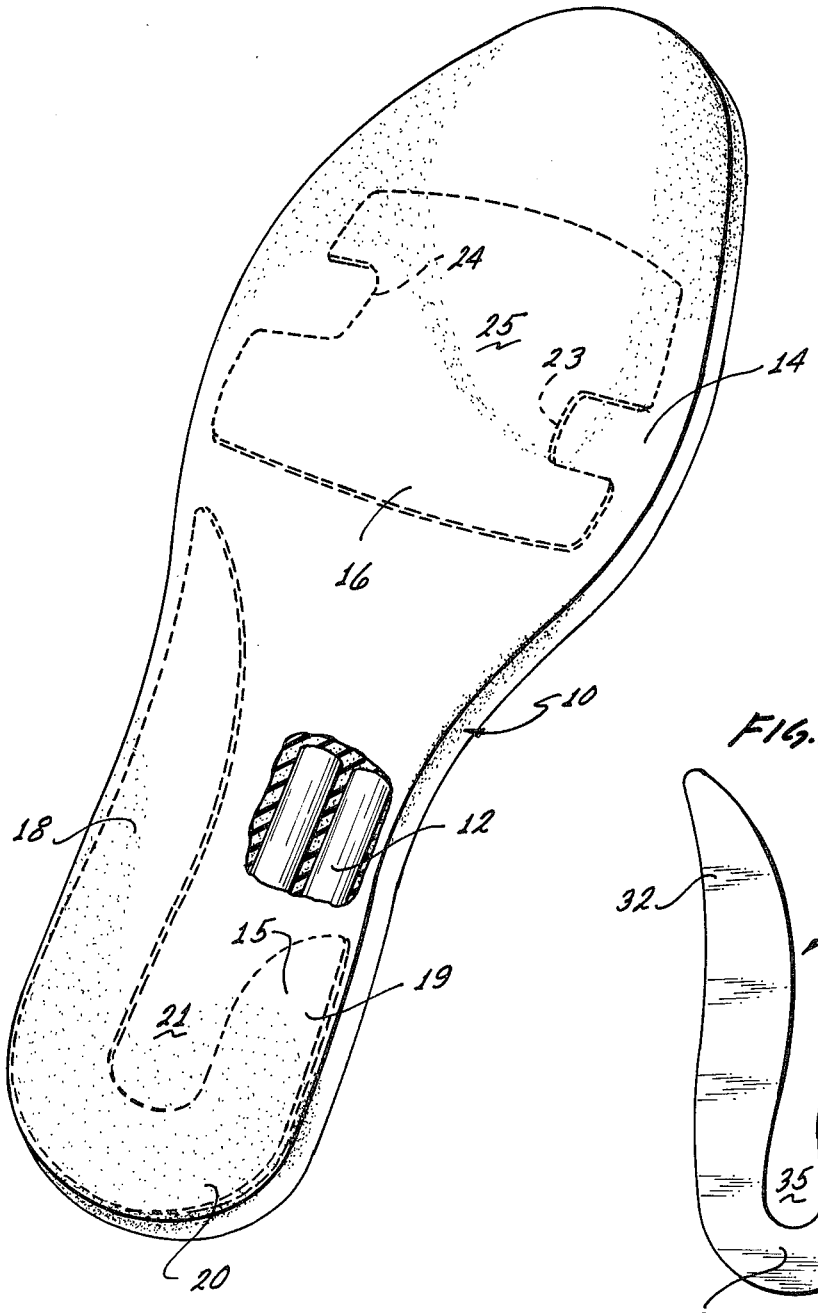
FIG. 1 is a view in perspective of an in-sole including a moderator structure in accordance with the present invention.

Referring to the drawings, which illustrate preferred forms of the present invention, FIG. 1 shows an in-sole or insert 10 adapted to be used in an article of footwear. In the form shown, the in-sole includes a foam component 12 which surrounds an air-gas in-sole 14 which may be of the type described in U.S. Pat. No. 4,219,945, for example, in which the foam encapsulates a multiple chambered in-sole 14. The in-sole 10 may be used as an inner sole slipped into an existing shoe, or it can be used as an integral composite mid-sole, or out-sole portion of a shoe.

In the form shown, the moderator is in the form of a heel moderator 15 and a fore moderator 16, each shown in dotted lines and each located above the air-gas in-sole 14 and positioned within the foam 12 and covered thereby and resulting in a unitary structure in which the moderator is associated with a cushioning material, which in this form is both the foam and air-gas in-sole, the latter performing the functions described in the patents previously referred to.

The moderators 15 and 16, which may be of the same or different material, are composed of a material which is spring-like and possesses a high tensile strength and a modulus of elasticity of at least 250,000. Typical materials are high-modulus plastics such polycarbonate materials (modulus of 300,000), available under the trademark "LEXAN", Type "E", fiberglass composites (modulus of 3,000,000), graphite composites (modulus of 9,000,000), and various types of metals such as steel, for example C-1075HTS steel (modulus of 30,000,000). Other materials which may be used are No. 301 stainless steel, cold rolled steel, full hardened stainless steel, C-1095 blue tempered cold rolled high-carbon spring steel, and other alloys, such as low and medium carbon steel, hot rolled nickel-chromium steel, vanadiam alloy steels, and other materials well known in the art. If desired, the material may be surface treated, especially the metals, by sandblasting or phosphate-etch to improve adhesion. Other procedures to improve adhesion as are known in the art may also be used.

The material of the moderator should possess good fatigue resistance due to the repeat bending encountered during use, and should likewise possess those qualities present in good spring material, i.e., energy storage and return. The material of the moderator should also have a reasonably high modulus of resilience, the strain energy which may be recovered from a deformed body when the load causing stress is removed, as measured in inch-pounds per cubic inch, should be relatively high, e.g., above about 10–12 inch-pounds per cubic inch.

To perform effectively in the context of not adding appreciable weight to the footwear, the moderator is preferably lightweight, and preferably relatively thin in order to reduce bulk. The cross-sectional thickness of the moderator may be in the range of 0.005 to 0.050 of an inch, and preferably in the range of about 0.010 to 0.020 of an inch. The moderator may of the same thickness throughout or may vary in thickness depending on the need for added support in localized areas, or more deflection in localized areas. Normally, the moderator is of essentially uniform cross-sectional thickness, although the heel and forefoot moderators, or the portion forming the heel and forefoot portion of the moderator, may be of different thickness or of different material, or both, depending upon the desired action.

Again, referring to FIG. 1, moderator 15 includes a lateral leg 18 along the outside of the foot and a medial leg 19 along the inside of the foot, the moderator 15 of FIG. 1 being illustrated for use in a shoe to be worn by the left foot. When used for a shoe to be worn on the right foot, the moderator 15 is simply turned over. As illustrated, the moderator 15 includes a heel portion 20 which interconnects the medial and lateral legs such that an open portion 21 exists forward of the heel portion and between the lateral and medial legs. In lieu of an open non-spring area 21, the area 21 may be of a much thinner or softer spring material such that the heel portion, and lateral and medial legs cooperate together to function as a Bellville spring, as will be described.

In the form illustrated in FIG. 1, the forefoot moderator 16 is separate from that of the heel and is located such that it is positioned beneath the load-bearing area of the foot in the distal end of the metatarsus. The lateral side of the heel moderator terminates short of the lateral side of the forefoot moderator and thus provides for ready flexure in that region, while the medial leg 19 is much shorter than the lateral leg. The moderator 16 includes cut-out sections 23 and 24 arranged to permit flexure in a longitudinal section, which is a zone 25 extending transversely across the width of the moderator. Even though flexure is permitted, the moderator 16 still acts as a spring in the longitudinal direction and functions as a spring in the transverse direction. This particular design of moderator assembly may be used in a court shoe such as a basketball shoe.

Figure 2:
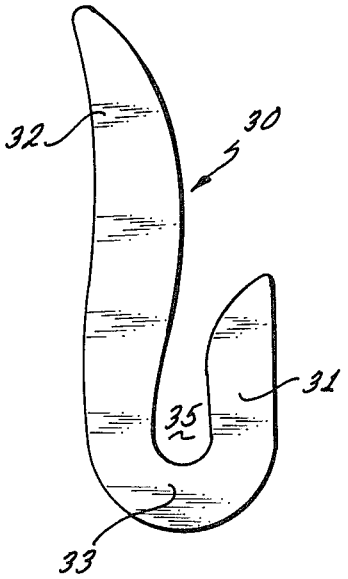
FIG. 2 is a plan view of a moderator structure in accordance with the present invention intended to be used as a heel moderator.

Referring now to FIGS. 2 and 3 through 5 and associated FIGS. 3*a* through 5*a* respectively, the function of the moderator may be understood with respect to the right foot. As seen in FIG. 2, the moderator is shown for use in the right shoe and includes a lateral leg 31 and a medial leg 32, the medial leg being longer than the lateral leg. The legs 31 and 32 are connected to a heel portion 33 forming an open area 35 forward of the heel portion and between legs. The open portion 35 is positioned to be located under the calcaneus.

Figure 3:
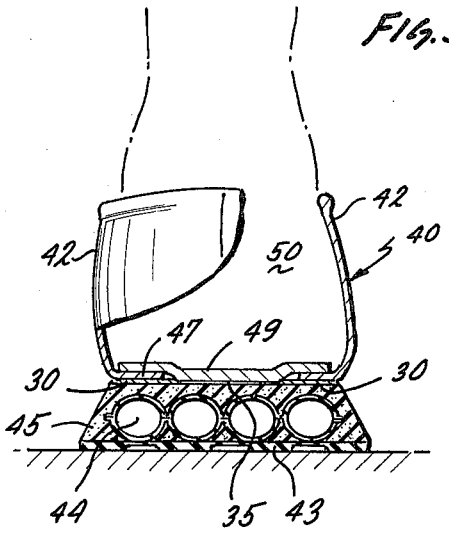
FIG. 3 is a diagrammatic view, partly in section and partly in elevation, of a shoe structure incorporating the moderator of the present invention, and indicating a no-load condition.
Figure 3A:
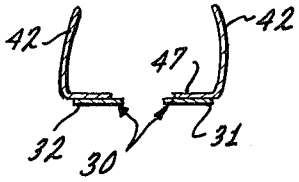
FIG. 3*a* is a diagrammatic view illustrating the relative location of the moderator and the shoe upper and heel counter under a no-load condition.

Referring to FIGS. 3 and 3*a*, the relative position of the foot is shown in a shoe 40 equipped with a moderator as shown in FIG. 2, for example. The shoe includes an upper 42 and an outsole 43 with an air-gas member 44 which is encapsulated by foam 45. The shoe upper includes a heel counter with a flange 47, the moderator 30 being located between the upper portion of the foam and beneath the flanges which extend inwardly toward the center of the shoe. Located above the flanges is a conventional sock liner 49.

As seen in FIG. 3, the calcaneus is positioned within the shoe such that the calcaneous is aligned over the open area 35 of the moderator 30 and effectively rests on a foam-air-gas substrate which, in effect, forms a cushioning medium. In the relative position of FIG. 3, there is no load on the shoe and this relative position of the parts indicates the normal non-stressed condition of the moderator system. FIG. 3*a* is a diagrammatic view of the shoe upper with the moderator 30 positioned beneath the flanges 47 as previously described, and again in the no-load position.

Figure 4:
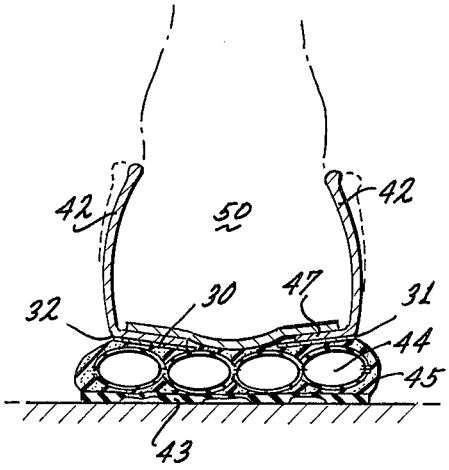
FIG. 4 is a view similar to FIG. 3 showing the relative position of the parts of the shoe structure of the present invention under medium-load conditions.
Figure 4A:
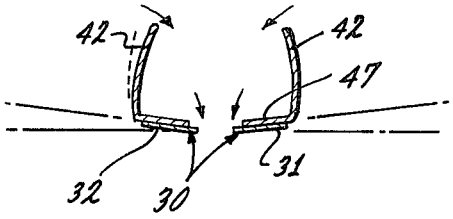
FIG. 4*a* is a view similar to FIG. 3*a* showing the relative position of the parts, in diagrammatic form, under a medium-load condition.

Referring now to FIG. 4, wherein the same references numerals have been used for the same parts, and also referring to FIG. 4*a*, as a load is applied to the heel, the calcaneus sinks somewhat into the foam-air-gas substrate 44, 45 resulting in small deflection of the moderator 30 under the medium load conditions imposed. As the medium load condition is imposed, the shoe upper moves from the dotted line position 42*a* to the full line position 42 gripping the foot firmly along the rear portion thereof around the rear portion of the heel, both along the lateral and medial side of the foot. As the calcaneus comes down under a load condition, the moderator deflects somewhat in the fashion of a Bellville spring, as illustrated in FIG. 4*a*, with the lateral and medial edges turning upwardly while the inner edges of the lateral and medial sides are urged downwardly, as schematically shown in FIG. 4*a*. The result is to urge the shoe upper inwardly more tightly against the bail of the heel of the foot in the response to the applied medium load. The moderator absorbs, redistributes and stores the energy of the localized load through the deflection such that the load is transmitted radially in all directions. Since the greatest downward load is in the area immediately adjacent the calcaneus there is greater deflection of the inner edges of the medial and lateral legs of the moderator 30. If the medium load is then removed, the moderator immediately returns to its original shape and at a rate which approximates and closely follows the rate at which the load is removed, as is apparent from a comparison of FIG. 4 with FIG. 3, or FIG. 4*a* with FIG. 3*a*. In returning to the original condition, the moderator returns to the user the energy absorbed during imposition of the deflecting stress.

Figure 5:
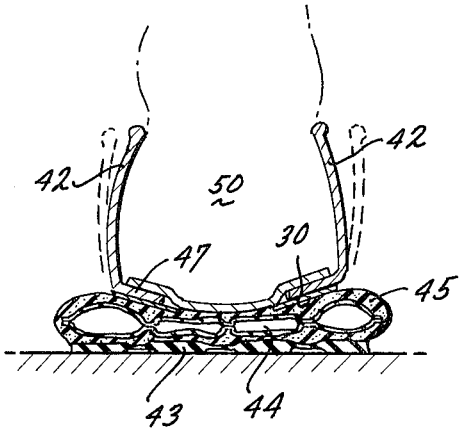
FIG. 5 is a view similar to FIGS. 3 and 4 illustrating the relative position of the parts of the shoe of the present invention under heavy load conditions; and, FIG. 5*a* is a view similar to FIGS. 3*a* and 4*a* diagrammatically illustrating the relative position of the parts under heavy load conditions.
Figure 5A:
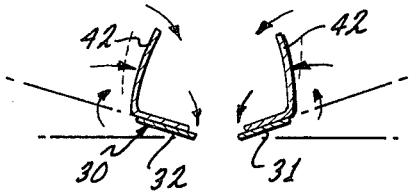

As illustrated in FIGS. 5 and 5*a*, again where the same reference numerals have been applied to the same parts, the imposition of a heavy load results in increased deflection over that shown in FIGS. 4 and 4*a*, with the result that there greater deflection elastically of the moderator and tighter engagement between the bale of the heel and the shoe upper in the region of the heel counter so as to cup the calcaneus and to center the heel in the shoe, thus providing firm and stable support under heavy load conditions of a degree somewhat greater than was achieved under medium load conditions or under the no-load conditions. Again the imposition of the load results in the energy being absorbed, redistributed and stored within the moderator system as the localized load is applied to produce deflection of the moderator, as shown, for example, in FIG. 5*a*, and return of the energy to the wearer at a rate which is equal to the rate at which the applied load is removed, since removal of the load results in a transformation from the relative position of the parts indicated in FIGS. 5 and 5*a*, as compared to the relative position of the parts in the no-load condition, as seen in FIGS. 3 and 3*a*.

The action which occurs at the forward end of the shoe is somewhat similar in that moderator 16 functions to deflect in response to the applied load, thus absorbing the load and redistributing the energy over the ball area of the foot, while storing the energy of the localized load, and, upon removal of the load, the moderator returns to its original shape and in so doing returns to the wearer the energy which is stored as a result of the deflection of the moderator as well as returning to the wearer the energy which has been stored in the foam-air-gas cushioning material beneath the moderator in the forefoot region of the shoe.

Dynamic tests of the shoe including the moderator system of the present invention have indicated that the shoe of the type illustrated in FIGS. 3–5, for example, functions 37% better in cushioning than the same shoe structure without the moderator of the present invention. Further, there appears to be an increase in efficiency of approximately 25% in the sense that there is somewhat greater flexibility of the shoe and a return of energy to the wearer which is 25% better than the same shoe without the moderator of the present invention.

As previously described, the moderator of the present invention also finds significant improvement of the performance of footwear which includes a cushioning material in the form of a foam, as opposed to a cushioning medium in the form of a foam encapsulated air-gas system. While the air-gas system performs per se much better than does a purely foam in-sole system, the moderator of the present invention also functions in a somewhat similar fashion to that already described in connection with shoe structures in which the moderator is positioned over a cushioning medium comprises entirely of foam. The action of the moderator is identical to what has been described in connection with FIGS. 3–5, although the amount of energy return is not as great because the amount of energy storage in the foam material is not as great as an air-gas system or a foam encapsulated air-gas composite.

As can be seen from the above description, the moderator of the present invention also provides improvement in activities such as running and in the case of activities involved in court sports such as basketball, in that if the athlete's foot lands either on the medial or lateral side, there is an absorption, redistribution and storage of energy, since the entire moderator system is capable of flexing in response to the applied loads. More particularly, if an athlete lands on the medial side of the foot, the medial side of the moderator system deflects downwardly and the lateral side tends to raise up slightly, thus providing advantages comparable to those described, i.e., snugging of the shoe around the foot to provide comfort and support during that type of load-bearing activity which is released and reduced gradually as the load is reduced, but with a significant difference that the energy stored in the moderator and in-sole system is returned to the athlete. Even where the action is such that the load is principally on the forefoot area, for example, coming down on the ball of the foot as opposed to the heel, the impact loads are absorbed and redistributed radially, causing the moderator to deflect and store the energy of the deformed load and to return the energy to the user as the moderator system returns to its original shape, as the load is removed.

In lieu of the form of moderator illustrated in FIG. 1, a moderator may be used which is of a single piece in that the leg 18 of moderator 20 is integral with moderator 16. Moderator 16 may in turn be provided with a plurality of fingers extending transversely of the shoe in order to provide greater flexibility in the lateral direction, that is across the lateral and medial side of the foot. In another form, moderator 16 may be in the form of a plurality of fingers extending from the lateral to the medial side with the ends of the fingers including upturned portions in order to provide greater support in those types of activities in which there is a lot of forefoot action and in which the athletes may land either on the medial or lateral side of the forefoot. The upstanding flanges assist in cupping the forward end of the shoe against the foot to provide added comfort and support.

It is also possible in accordance with the present invention to use a moderator only under the forefoot of the shoe, particularly with those shoes in which the type of activity normally does not involve heel impact, for example, speed running in which the shoe includes a spike portion principally under the forward end of the shoe and wherein the heel of the shoe generally does not strike or impact the ground during the normal course of the sporting event. In that type of structure, the advantages previously described are obtained in that the moderator again functions to absorb, redistribute and store the energy of the localized load and return the energy to the athlete as the load is removed while at the same time providing comfort and support.

As already noted, the moderator used in the heel may include a leg which is longer on the medial side as compared with the lateral side, or vice versa, or the legs may be of equal length. By increasing the length of the leg on the medial side, some addition arch support is provided which may be advantageous in certain types of shoe structures.

In another form of moderator in accordance with this invention, the moderator may include portions which are serpentine in structure in order to provide increased bending and flexibility in certain areas of the shoe structure. For example, the portion of the medial side of the moderator may include a serpentine tip which permits easy flexure in the area underneath the arch while also providing arch support. So, too, the lateral side of the moderator may include a serpentine strip for flexibility while the portion of the moderator beneath the forefoot may likewise be made of a serpentine strip which in effect provides a plurality of parallel fingers with adjacent fingers interconnected at their opposite ends, thereby providing flexibility and support in addition to the functions already previously discussed.

In an attempt to measure objectively the relative energy absorption and energy return efficiency of the moderator system of the present invention, a series of pendulum tests were performed which basically involved allowing a pendulum to strike against the system under test and counting the number of strikes until the pendulum ceased swinging. In the tests performed, the pendulum weight was approximately 45 pounds, and the test specimens were rigidly supported against a suitable support mechanism such that the pendulum was free to swing, strike the test specimen, bounce up, and thereafter continue freely to hit the test specimen. A count of the number of times the test specimen was hit until the pendulum stopped swinging provided a relative indication of the efficiency with which the system under test returned energy to the pendulum. In each test in the series there were multiple runs of each of the systems tested and the numbers for each system were averaged over the number of runs for each system tested.

In the first test, a comparison was made between an air-gas in-sole which was not encapsulated in foam and essentially of a structure described in U.S. Pat. No. 4,183,156, inflated to approximately 25 to 28 psi gauge. This air-gas system product was one presently used commercially in a brand of shoes known as MARIAH. Multiple runs were made in which the number of impacts by a 45-pound pendulum were counted and until the pendulum stopped swinging and the numbers averaged out to 17.5. In the companion test of the same material, a moderator was used essentially as shown in FIG. 2 and composed of 301 stainless steel of a thickness of approximately 0.010 of an inch. The moderator was assembled into contact with the air-gas system in-sole tested in the first series, and the result of multiple runs of the second system indicated an average of 27.5 impacts before the pendulum stopped. The increase in approximately ten impacts is an increase in the relative energy return efficiency between the same air-gas system with and without the moderator of the present invention.

In another series of tests, an improved air-gas insole using a nylon taffeta enclosure material inflated to approximately 25 to 28 pounds was tested, again in a series of tests, resulting in an average number of impacts of 27.5. The same material run in a companion test using the moderator already described and again run in a series of tests, produced 34 impacts until there were no more impacts by the pendulum. In this particular series the increase was significant.

In a third series of tests, three different structures were tested, as follows. Structure A was a foam-encapsulated air-gas system as illustrated in FIG. 1 of this application, and described in detail in U.S. Pat. No. 4,219,945 and in a form currently being used commercially in a shoe sold under the designation TAILWIND. Structure B was identical to structure A except it incorporated a moderator of the configuration illustrated in FIG. 2 of this application, the moderator being fabricated 301 stainless steel and having a cross section thickness of 0.010 of an inch. Structure C included the air-gas-foam rubber substrate of structure A except that the moderator, of a configuration of FIG. 2 of this application, was structured of a material having a comparatively low modulus in the range of 50,000 to 80,000 and was fabricated of a material known as "TEXON" and approximately 0.080 of an inch in cross-sectional thickness. In structure C, the low modulus moderator was assembled over the air-gas system tested in structure A. Each structure was tested in a series of multiple tests and the results averaged to provide the following number of impacts: (a) structure A, 25 impacts, (b) structure B, 29 impacts, and (c) structure C, 22 impacts.

In still another series of tests, three additional structures were evaluated including structure A, which was a foam material used as a mid-sole, the material being described as a standard currently produced "PHYLON" terra t/c foam material including an outer skin. The foam material was an ethylene vinyl acetate foam. The second structure was the foam mid-sole described using a high-modulus 301 stainless steel moderator of a shape illustrated in FIG. 2 and having a cross-sectional thickness of 0.010 of an inch. The third structure involved the foam mid-sole previously described with a low-modulus moderator of "TEXON" as already previously described. Again, multiple tests were run for each series with the following results: (a) foam mid-sole alone, 20; (b) foam mid-sole with steel moderator, 28; and (c) foam in-sole with TEXON moderator, 17.5.

In the tests above described, the moderator shape was essentially the same and located approximately in the same position in each of the test specimens. The pendulum was arranged in each test to strike the specimen at approximately the same location where the calcaneus would come down on the substrate and all tests were run in that fashion.

On the basis of the above date, the presence of a high-modulus moderator consistently improved the energy adsorption and energy return characteristics of the system under test. The use of a high-modulus moderator in combination with an all foam mid-sole increased the energy adsorption and energy return characteristics to a level greater than the same system without the moderator and to a level greater than that of foam-encapsulated air-gas systems. The use of low-modulus moderators demonstrated a significant loss of efficiency when used either with foam-encapsulated air-gas systems or with foam systems. The performance of the nylon taffeta cloth, which was urethane coated, and which included a high-modulus moderator, was the most efficient system of all of those tested in the series.

From the above description, it will become apparent that the use of a moderator of a high-modulus of elasticity material, significantly improves the performance of footwear in the absorption, redistribution, storage of energy as a result of applied localized loads through deflection of the moderator, and by returning energy to the wearer in a useful form. It is within the scope of the present invention to provide a moderator assembly which includes a moderator which overlies a cushionable substrate and which is separate from the shoe structure as manufactured and which may be inserted into the shoe much in the same fashion as a conventional insole insert.

In addition to providing the energy return characteristics described, the moderator of the present invention also provides the advantage of increased comfort and support, particularly in those types of physical activities and under those circumstances which require support, or added support because of the nature of the physical activity involved. Unlike the moderators of the prior art, the moderator of the present invention is effective, through elastic deflection and return, in efficiently returning to the wearer energy which heretofore, and in some of the prior art systems, have been dissipated and lost. In further dynamic tests using a foam-encapsulated air-gas system and the moderator of the present invention, an increase of up to approximately 6% to 6½% in athlete effiency has been noted. While in terms of relative numbers, this may seem relatively small, it must be remembered that small increases in efficiency, as measured by oxygen uptake, can result in significant advantages, especially in long-distance running.

It is contemplated that numerous changes, modifications and/or additions may be made to the specific embodiments of the present invention shown in the drawings and described above without departing from the spirit and scope of the present invention. Accordingly, it is intended that the scope of this patent be limited only by the scope of the appended claims.

What is claimed is:

1. An article of footwear of the type described, comprising:

an upper and at least a sole secured to said upper such that the wearer's foot is positioned within said upper and above said sole, cushioning material located between said sole and the wearer's foot, a high modulus moderator located between the wearer's foot and above said cushioning material, said moderator being a relatively thin, lightweight member of a material having a modulus of elasticity of at least about 250,000 psi, said moderator including a medial leg and a lateral leg and a heel portion interconnecting said two legs, said legs and heel portion being relatively flat, said moderator being positioned within said midsole and above said cushioning material such that when the wearer's foot is inserted into the footwear the medial and lateral legs overlie the cushioning material and are located on each side of the calcaneus while the rear portion of the moderator overlies the cushioning material and is located behind the calcaneus whereby a cushioning medium is provided below the calcaneus, said moderator being characterized further by the ability to deflect without permanent deformation in response to an applied load creating a deflecting stress and to return to its original shape upon removal of the applied load causing the deflecting stress, said medial and lateral legs including peripheral portions spaced from the location of the calcaneus and portions adjacent to the location of the calcaneus whereby in response to a load the portions of said moderator adjacent to the calcaneus deflect in one direction while the portions thereof spaced from the calcaneus deflect in another direction, and said moderator being operative to absorb, redistribute and store the energy of localized loads applied thereto through deflection and to return energy to the wearer at a rate equal to or greater than the rate at which the applied load is removed.

2. An article of footwear as set forth in claim 1 wherein said moderator has a cross-sectional thickness of between 0.005 and 0.050 of an inch.

3. An article of footwear as set forth in claim 1 wherein said moderator is of a spring steel alloy.

4. An article of footwear as set forth in claim 1 wherein said moderator is reinforced composite plastic.

5. An article of footwear as set forth in claim 1 wherein said medial leg is longer than said lateral leg.

6. An article of footwear as set forth in claim 1 wherein said lateral leg is longer than said medial leg.

7. An article of footwear as set forth in claim 1 wherein said cushioning material is a compressible foam.

8. An article of footwear as set forth in claim 1 wherein said cushioning material is a foam encapsulated air-gas material.

9. An article of footwear as set forth in claim 1 wherein said cushioning material is an air-gas material.

10. An article of footwear as set forth in claim 1 wherein said cushioning material includes a pressurized air-gas material.

11. An article of footwear as set forth in claim 1 wherein said upper includes a heel counter having flange means which extends inwardly, said flange means being located on one side of said moderator, and said flange means cooperating with said moderator and said cushioning material to urge the upper into more tight contact with the ball of the wearer's heel in response to a load applied to said moderator.

12. An article of footwear as set forth in claim 1 wherein there is a space between the portions of the medial and lateral legs of the moderator adjacent to the location of the calcaneus, and said cushioning material including a portion in the said space between said legs and located beneath the calcaneus such that when a load is applied the calcaneus is cushioned by the cushioning material while the moderator deflects.

13. An article of footwear as set forth in either of claims 7 or 8 wherein the foam encapsulates the moderator.

14. An article of footwear as set forth in claim 1 wherein an additional moderator is positioned in the forefront of said footwear, said additional moderator being a relatively thin, lightweight member of a material having a modulus of elasticity of at least about 250,000 psi, and being characterized further by the ability deflect without permanent deformation in response to an applied load creating a deflection stress, and being operative to absorb, redistribute, and store the energy of localized loads applied thereto through deflection and to return energy to the wearer at a rate equal to or greater than the rate at which the applied load is removed therefrom.

15. A cushioning material and moderator assembly of the type described for use in footwear, comprising:

a moderator of a relatively thin, lightweight material having a modulus of elasticity of at least about 250,000 psi, a cushioning material located beneath said moderator to permit said moderator to deflect without permanent deformation in response to an applied load creating a deflecting stress and permitting said moderator to return to its original shape upon the removal of the applied load causing the deflecting stress, said moderator including a medial leg and a lateral leg and a heel portion interconnecting said two legs, said legs and heel portion being relatively flat, a member overlying said moderator and cooperating therewith to form an insert which may be placed in the footwear and positioned therein such that the calcaneus of the wearer's foot is located between said legs and forward of the heel portion of the moderator and overlies a portion of said cushioning material, said moderator being characterized further by being relatively flat in a no-load condition and by the ability to deflect without permanent deformation in response to an applied load creating a deflecting stress and to return to its original shape upon removel of the applied load causing the deflecting stress, said medial and lateral legs including perpheral portions spaced from the location of the calcaneus and portions adjacent to the location of the calcaneus whereby in response to a load the portions of said moderator adjacent to the calcaneus deflect in one direction while the portions thereof spaced from the calcaneus deflect in another direction, and said moderator being operative to absorb, redistribute and store energy of localized loads applied thereto through deflection and to return energy to the wearer at a rate equal to or greater than the rate at which the applied load is removed.

16. A cushioning material and moderator assembly as set forth in claim 15 wherein said cushioning material is a compressible foam.

17. A cushioning material and moderator assembly as set forth in claim 15 wherein said cushioning material is a foam encapsulated air-gas material.

18. A cushioning material and moderator assembly as set forth in claim 15 wherein said cushioning material is an air-gas material.

19. A cushioning material and moderator assembly as set forth in claim 15 wherein said cushioning material includes a pressurized air-gas material.

* * * * *